United States Patent [19]

Neuworth

[11] 4,298,451

[45] Nov. 3, 1981

[54] TWO STAGE LIQUEFACTION OF COAL

[75] Inventor: Martin B. Neuworth, Chevy Chase, Md.

[73] Assignee: The United States of America as represented by the United States Department of Energy, Washington, D.C.

[21] Appl. No.: 124,057

[22] Filed: Feb. 25, 1980

[51] Int. Cl.[3] ..... C10G 1/00; C10G 1/06; B01J 1/00

[52] U.S. Cl. ..... 208/8 LE; 208/10; 422/188

[58] Field of Search ..... 208/8 LE, 10; 422/188

[56] References Cited

U.S. PATENT DOCUMENTS

| | | | |
|---|---|---|---|
| 3,488,279 | 1/1970 | Schulman | 208/10 |
| 3,598,718 | 8/1971 | Gleim et al. | 208/8 LE |
| 4,081,351 | 3/1978 | Heinemann | 208/8 LE |
| 4,097,361 | 6/1978 | Ashworth | 208/10 |
| 4,102,774 | 7/1978 | Carr et al. | 208/10 |
| 4,119,523 | 10/1978 | Baldwin et al. | 208/8 |
| 4,133,740 | 1/1979 | Paraskos et al. | 208/8 |
| 4,158,622 | 6/1979 | Schwarzenbek | 208/177 |
| 4,159,237 | 6/1979 | Schmid | 208/10 |

OTHER PUBLICATIONS

LC-Fining Produces Low Nitrogen Distillates from Solvent Refined Coal, Chillingworth et al., Cities Service Co., Box 300, Tulsa, OK 97104, Nov. 15, 1978.

Short Residence Time Cat. Two-Stage Process SRC Process, Garg et al., Auburn Coal Research Lab. Auburn, Alabama 71st/AIchE, Mi., Fla.

New Liq. Tech. By Short Contact Time Process, Mitchell et al., Mobil Research and Development Corp., Paulsboro, N. J., 71st/AIchE, Mi., Fla. 11/13/78.

Liq. of Solid Carb. Materials, L.E. Sinoff, Jr., et al., presented at "World Conference. . ." Toronto, Ontario, Canada, Jul. 10-13, 1978.

"A New Process for Removing Ash from Coal Liq. by $H_2$" Sze et al., Proceeding of Am. Power Conference 1975, vol. 37, pp. 315-321.

Clean Fuels-West., Phase I. Tech. Summary 11/75, Conoco Coal Development Co., pp. 1-32.

*Primary Examiner*—Delbert E. Gantz
*Assistant Examiner*—William G. Wright
*Attorney, Agent, or Firm*—Michael Esposito; Richard G. Besha; James E. Denny

[57] ABSTRACT

A two stage coal liquefaction process and apparatus comprising hydrogen donor solvent extracting, solvent deashing, and catalytic hydrocracking. Preferrably, the catalytic hydrocracking is performed in an ebullating bed hydrocracker.

12 Claims, 1 Drawing Figure

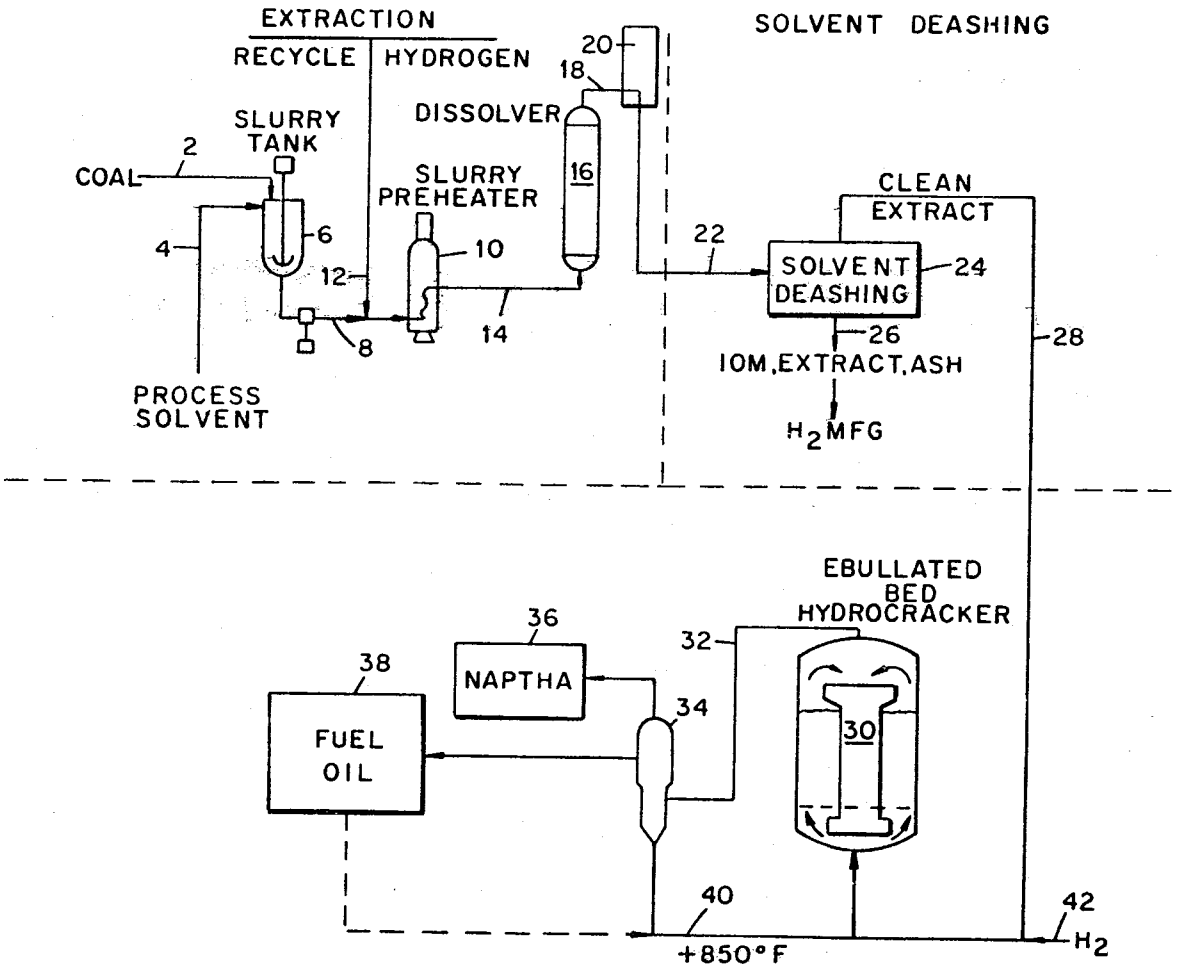
SOLVENT DEASHING
EXTRACTION
RECYCLE
HYDROGEN
COAL
2
SLURRY TANK
6
4
PROCESS SOLVENT
12
8
SLURRY PREHEATER
10
DISSOLVER
16
14
18
20
22
CLEAN EXTRACT
24
SOLVENT DEASHING
26
IOM, EXTRACT, ASH
$H_2$MFG
28
EBULLATED BED HYDROCRACKER
30
32
34
36
NAPTHA
38
FUEL OIL
40
+850°F
42
$H_2$

TWO STAGE LIQUEFACTION OF COAL

BACKGROUND OF THE INVENTION

The present invention relates to a process and apparatus for converting solid, hydrogen deficient, ash containing, hydrocarbonaceous materials (e.g. coal) into liquid hydrocarbon materials. Particularly, the invention relates to a two stage process and apparatus for direct conversion of coal into liquid products.

It was recognized in the early 1900's in Germany that the conversion of coal to hydrocarbon fuel liquid was possible. This conversion process was referred to as coal liquefaction. Coal liquefaction may be accomplished by either direct or indirect liquefaction. Conversion of coal to liquid by the use of heat and hydrogen is designated as direct liquefaction. Conversion of coal to liquid with an intermediate step of gasification of the coal into synthesis gas ($CO+H_2$) followed by chemical combination of the synthesis gas into liquids is termed indirect liquefaction. The present invention relates to a two stage direct liquefaction process and apparatus.

Generally, direct liquefaction describes a number of processes which include the basic steps of breaking coal into small fragments and adding hydrogen to these fragments to produce liquid fuels. One previous commercial direct liquefaction process known as the "Bergius Process" was operated on a commercial scale in Germany during World War II. The Bergius Process, however, operated at severe conditions of 10,000 psi and 900° F. with an overall efficiency of about 46 percent (Btu in/Btu out). Pilot facilities operating on the Bergius principles were also built in the United States after World War II. These facilities were eventually closed down in the mid-1950's since they clearly could not compete economically with low cost crude oil.

With the advent of the current oil shortage and our present day energy crisis, economics presently favor the development of liquid hydrocarbon fuels from coal. In view of the vast coal reserves of the United States, it is evident that the development of new, improved, and economical coal liquefaction techniques will be of paramount importance in any solution to our energy problems.

At present, the direct coal liquefaction process generally comprises charging a preheater/reactor maintained at temperatures of about 750°–850° F. and pressures of about 1500–2000 psi with a slurry of coal, a process derived solvent and hydrogen. Under these conditions, almost all (above 75 percent) the coal dissolves and provisions are made to separate the unconverted coal and ash followed by distillation of liquid according to boiling range.

Direct coal liquefaction can be accomplished by either a one stage, or a two stage process. One stage liquefaction is defined as a process wherein the conversion from coal to distillate liquid (i.e. liquid hydrocarbon fuel) takes place in a single reactor by contacting coal, process derived solvent and hydrogen. Two stage liquefaction defines a process wherein there is a separation of the primary extraction step from the hydrocracking of the extract to distillate.

In the 1950's, a two stage liquefaction process known as the "CSF Process" was proposed. This CSF process was the first application of an expanded bed hydrocracker to clean extract resultant from the primary extraction step. The extract was cleaned by mechanical means, such as filters or a hydroclone. In addition, the CSF process did not add hydrogen in the extraction step which limited the yield of extract to about 75 percent. The results of this process were not promising (e.g. 1.83 bbl/ton with a hydrogen consumption of 6500 SCF/barrel) and the process was abandoned. Before abandonment of the CSF process an attempt was made to clean the extract by solvent deashing. However, the extraction step was still performed without the aid of hydrogen and no hydrocracking of the deashed extract was attempted.

Recent developments in coal liquefaction have concentrated on improvements in the one stage liquefaction process. At present there are three processes which have developed to a point of being considered serious candidates for commercialization: Solvent Refined Coal (SRC-I and SRC-II), H-Coal, and Exxon Donor Solvent (EDS). Each of these processes is a one stage liquefaction because (a) there is no separation of the primary extraction step from the step of hydrocracking of the extract to distillate, and (b) conversion of coal to distillate liquid takes place in a single reactor by contacting coal, process derived solvent and hydrogen.

The SRC process may be operated in two modes designated as SRC-I and SRC-II. The SRC-I process utilizes a high coal throughput feed rate during the primary extraction step followed by hydrocracking of the extract. This process produces a solid fuel resembling coal with very low ash and reduced sulfur content. The SRC-II process utilizes a low coal throughput feed rate during the primary extraction step with a recycle of the unconverted coal and heavy liquid. The SRC-II process results in a distillate fuel product part of which can be burned as fuel and the remainder refined as high octance gasoline.

The H-Coal process is derived directly from commercial H-Oil hydrocracking processes. The H-Oil process utilizes a reactor known as an ebullating bed in a catalytic process to upgrade heavy solids containing petroleum resids. The heavy solids containing petroleum resids are introduced into the catalytic ebullating bed hydrocracker resulting in the formation of a liquid fluidized bed comprising catalyst particles suspended in petroleum resids. The catalyst particles and hydrogen present in the ebullating bed hydrocracker upgrade the petroleum resid to a lighter liquid product. The heavy solids present in the petroleum resids deposit out onto the catalyst surface. Due to the unique design of the ebullating bed, the liquid product is recirculated through the catalyst particles establishing a flushing action which tends to wash some of the solids off the catalyst particles reducing deactivation and increasing catalyst lifetime. This H-Oil process has been applied directly to hydroextracted liquid coal without removal of ash or unconverted coal.

The Exxon Donor Solvent (EDS) Process applies known commercial petroleum processing steps to coal conversion. It was discovered that hydrotreating the process solvent by passing the solvent over an active catalyst to obtain a predetermined hydrogen content produced an enhanced process solvent. This enhanced process solvent could be used to dissolve and hydrocrack coal in the presence of hydrogen without the use of a catalyst. The net effect of the use of the more effective solvent is that only clean, distillate process solvent contacts catalyst resulting in minimal catalyst fouling and total distillate fuel yields comparable to those obtained by the SRC-II and H-Coal processes.

While the above described one stage processes represent some improvement over the earlier Bergius and CSF processes, they possess the disadvantages of relatively low yield of liquid hydrocarbon product and too high consumption of hydrogen.

SUMMARY OF THE INVENTION

It is the primary object of the present invention to provide a new and improved two stage process and apparatus for converting solid, hydrogen-deficient, ash containing hydrocarbonaceous materials into liquid hydrocarbon product.

It is another object of the present invention to provide a new and improved two stage process and apparatus for direct coal liquefaction.

It is still another object of the present invention to provide a new and improved two stage process and apparatus for direct coal liquefaction wherein a high coal throughput rate can be maintained during the solvent extraction zone.

It is a further object of the present invention to provide a new and improved two stage process and apparatus for direct coal liquefaction wherein hydrogen consumption per unit of liquid hydrocarbon product is minimized.

It is a still further object of the present invention to provide a novel two stage coal liquefaction process and apparatus which results in a high yield of liquid hydrocarbon product.

It is a still further object of the present invention to provide a novel two stage coal liquefaction process and apparatus wherein the liquid hydrocarbon product possesses low nitrogen, oxygen, and sulfur content.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention as embodied and broadly described herein, the process of this invention comprises solvent extracting of a solid, hydrogen deficient, ash containing, hydrocarbonaceous material to produce a liquid extract product, subjecting the liquid extract product to solvent deashing to produce a clean extract, and hydrocracking the clean extract to produce liquid hydrocarbons.

In a preferred embodiment of the present invention, the process comprises extracting a solid, hydrogen deficient, ash containing, hydrocarbonaceous material with a hydrogen donor solvent (e.g. process derived solvent) in a hydrogen extraction zone. The conditions present in the extraction zone are such that substantially all (at least 90 percent) of the solid, hydrogen-deficient, ash containing, hydrocarbonaceous material is converted to a liquid extract product. This liquid extract is fractionated to separate the light liquids (e.g. $C_5-500°$ F. distillate) and gases ($C_1$-$C_4$) from the heavy liquid extract (+500° F.). The heavy liquid extract is then subjected to solvent deashing which produces a clean extract. The deashing solvent is removed by distillation. Finally, the clean extract is hydrocracked in a catalytic hydrocracker, preferrably a catalytic ebullating bed hydrocracker, to produce suitable liquid hydrocarbons, such as naphtha, ($C_4-390°$ F.) and fuel oil (390°-850° F.) as major products.

Preferably, the solid, hydrogen-deficient, ash containing, hydrocarbonaceous material is coal and the hydrogen donor solvent is a process derived solvent.

Preferably, the conditions in the extraction zone are such that at least 90 percent of the solid, hydrogen-deficient, ash containing, hydrocarbonaceous material is converted into liquid extract product. Illustrative of these conditions are temperatures in the range of about 600°-850° F., a coal feed rate of about 50-250 lbs/hr/ft$^3$ and a hydrogen pressure of about 1000-2000 psi.

Further, the catalytic ebullating bed hydrocracker is preferably maintained at a temperature of about 750°-825° F. and a hydrogen pressure of about 2000-3000 psi.

In a further preferred embodiment, the coal throughput rate (i.e. feed rate) through the extraction zone is maintained at 150-250 lbs/hr/ft$^3$. This enables a mild extraction in the first stage which takes full benefit of the second stage catalytic hydrocracking in the ebullating bed.

The catalytic material present in the ebullating bed hydrocracker is preferably NiMo.

In a further aspect of the present invention, apparatus is provided for a two stage conversion of solid, hydrogen-deficient, ash containing, hydrocarbonaceous materials into liquid hydrocarbon product. The apparatus comprises means for solvent extracting a solid, hydrogen deficient, ash containing, hydrocarbonaceous material to produce a liquid extract product, means for solvent deashing the liquid extract product to produce a clean extract, and means for hydrocracking the clean extract to product liquid hydrocarbons.

In a further preferred aspect of the present invention the above described apparatus includes means for fractionating the liquid extract product to separate light hydrocarbons and gases from heavy liquid extract and means for removing deashing solvent from the clean extract. Additionally, the hydrocracking means is a catalytic ebullating bed hydrocracker.

The present invention represents a material improvement over the previously discussed two stage coal liquefaction processes and apparatus, and produces a substantial improvement in yield and quality of liquid hydrocarbon compared to the highly regarded one stage processes such as SRC, H-Coal, and EDS.

The accompanying drawing which is incorporated in and forms a part of the specification is a schematic illustration of the process and apparatus of the present invention.

DETAILED DESCRIPTION OF THE INVENTION

The present invention is directed to a two stage coal liquefaction process and apparatus. The process is referred to as a "two stage coal liquefaction" process because there is (a) separation of the primary extraction step from the step of hydrocracking the extract and (b) conversion of coal to distillate liquid does not take place in a single reactor. More particularly, and as described in detail in the ensuing description, a solvent deashing operation is performed on the extract prior to its delivery into a hydrocracker and conversion of coal into distillate liquid takes place in a fractionator.

A detailed description of the two stage coal liquefaction process and apparatus of the present invention will now be set forth with reference to FIG. 1. In the first stage, fragmented (e.g. ground or pulverized) coal is introduced into slurry tank 6 by a conduit 2. A hydrogen donor solvent (process solvent) is also introduced into slurry tank 6 by conduit 4. The coal and solvent are then admixed in tank 6 to form a slurry. The slurry is transported from tank 6 by a conduit 8 to a slurry preheater 10. Hydrogen is introduced into the slurry by a conduit 12 connected to conduit 8 between the tank 6 and preheater 10. In preheater 10, the slurry is heated and then transported by conduit 14 to a dissolver 16. The slurry remains in the dissolver until substantially all of the solid material (over 90%) is dissolved. The dissolved material is then transported by conduit 18 to fractionator 20. In fractionator 20, the dissolved material is topped, preferably by distillation, to remove light liquids (−500° F.) and gases.

Between the foregoing described first stage of the direct liquefaction process and apparatus of the present invention and the second stage thereof described hereinafter, a solvent deashing operation is provided. Particularly, the remaining heavy liquid extract resultant from fractionator 20 is transported via conduit 22 to a solvent deashing operation 24. The solvent deashing operation, may be achieved by any known processes and apparatus, not per se forming a part of this invention. For example, either the Lummus antisolvent process or the Kerr-McGee supercritical technique may be utilized in the solvent deashing operation. Insoluable organic material (IOM), ash, and extract are removed from the heavy liquid subjected to the solvent deashing operation via conduit 26. The clean heavy extract obtained is transported via conduit 28 to the second stage of the process, i.e., hydrocracking. Hydrocracking is performed in a hydrocracker 30. The hydrocracked product is then transported via conduit 32 to a known fractionator 34. In fractionator 34, separation of light hydrocarbons, such as Naphthas, ($C_4$−390° F.) 36 and fuel oil (390°-850° F.) 38, takes place. Any (+850° F.) product still present may be recycled via conduit 40 into hydrocracker 30 for reprocessing. Hydrogen may be added to hydrocracker 30 via line 42.

In a preferred embodiment of the present invention, the fragmented coal is transported to slurry tank 6 at a rate of about 50-250 lbs/hr/ft$^3$. The slurry preheater 10 and dissolver 16 are maintained at temperatures in a range of about 600°-850° F. and a hydrogen pressure in a range of about 1000-2000 psi. The liquid extract produced in dissolver 16 is subsequently fractionated to remove light liquids and gases. The heavy liquid extract (bottoms) is transported to the solvent deashing operation 24 where insoluble organic material, ash, and extract are removed. Solvent deashing is achieved by known processes. For example, the Lummus antisolvent process described in a paper by Sze, et al. entitled, "A New Process For Removing Ash From Coal Liquefied Hydrogenation," 37 *Proceedings of the American Power Conference,* pages 315-321 (1975), or the Kerr McGee supercritical deashing technique described in a paper presented by Baldwin, et al. entitled, "Critical Solvent Deashing—A New Solids Separation Method for Coal Liquefaction Processes," presented at the Fourth International Conference on Coal Gasification, Liquefaction, and Conversion to Electricity at the University of Pittsburgh, Pittsburgh, Pa.; Aug. 2-4, 1977 may be utilized. Both of the foregoing identified papers are herein incorporated by reference. The clean extract produced by the solvent deashing operation 24 is transported to a catalytic hydrocracker where hydrocracking takes place at temperatures in a range of about 750°-825° F. and hydrogen pressures of about 2000-3000 psi. Any suitable known catalytic hydrocracking apparatus may be utilized. Preferrably, however, the hydrocracker apparatus comprises an ebullating bed hydrocracker of known construction. For example, see U.S. Pat. No. 4,158,622 herein incorporated by reference.

In a further preferred embodiment of the present invention, the conditions in the extraction stage are moderated in terms of residence time to take full advantage of the second stage hydrocracking. This moderation is termed "mild extraction". Accordingly, a coal throughput rate of about 150-250 lbs/hr/ft$^3$ is used in this embodiment resulting in a shorter residence time in the extraction stage.

A comparison of the product distribution obtained by a Standard SRC (I) process and the two stage process of the present invention operated at a high coal throughput rate (i.e. HTE Extract) is set forth in Table I below:

TABLE I

COMPARISON OF HYDROBRACKING OF STANDARD SRC AND HTE EXTRACT

| Feedstock | Standard SRC | | Two Stage HTE | |
|---|---|---|---|---|
| Average Reactor Temp °F. | 780 | | 780 | |
| Space Velocity ($XSV_0$) | .39 | | .55 | |
| Catalyst | NiMo | | NiMo | |
| Conversion Vol. % | 55.4 | | 62.2 | |
| Yield Wt. % of Feed | | | | |
| $H_2O$, $H_2S$, $NH_3$ | 3.7 | | 7.2 | |
| $C_1$-$C_4$ | 5.9 | | 4.0 | |
| $C_5$-390° F. | 7.4 | | 8.5 | |
| 390-500° F. | 9.8 | | 9.3 | |
| 500-650° F. | 27.9 | 64 | 23.9 | 62 |
| 650-850° F. | 26.2 | | 28.8 | |
| 850° F.+ | 22.6 | | 21.8 | |
| $H_2$ Consumption SCF/Bbl Feed | 2840 | | 2620 | |

The results set forth in Table I demonstrate that the product distribution obtained by the two stage process of the present invention operated at a high coal throughput rate (i.e. 150 lbs/ft$^3$/hr) showed very similar conversions, product distributions, and hydrogen consumption compared with standard SRC (I) product obtained with a coal throughput rate of about 50 lbs/ft$^3$/hr. Accordingly, it can be stated that the high throughput rate does not materially effect the coal conversion and advantageously substantially diminishes the amount of hydrogen consumed per ton of coal. This results in a substantial economic savings.

In the present invention, any conventional hydrogen donor material may be utilized in the extraction zone (e.g. Tetralin). Preferably, the hydrogen donor material used is a process derived solvent comprising various partially hydrogenated aromatics, such as 3 and 4 ring aromatics boiling in the range of 500°-850° F. The catalyst used during hydrocracking in the ebullated bed may comprise materials known in the art such as Ni, Mo, and Co. Preferably, however, a NiMo catalyst is used.

The effectiveness of the two stage liquefaction process and apparatus of the present invention is best illustrated by comparing product distribution from the three advanced one stage processes (SRC-II, H-Coal, and EDS) discussed in the Background of the Invention and the corresponding distribution from the two stage liquefaction process of the present invention. This comparison is set forth in Table II below:

TABLE II

COMPARISON OF PRODUCT DISTRIBUTION FROM VARIOUS LIQUEFACTION PROCESSES

| YIELDS/TON OF COAL | | EDS | H-COAL | SRC-II | PRESENT-INVENTION TWO STAGE |
|---|---|---|---|---|---|
| PIPELINE GAS | CUFT | 2591 | 2280 | 2700 | 1528 |
| LPG | BBL | (0.4)[1] .13 | 0.15 | 0.5 | 0.13 |
| NAPHTHA | BBL | 0.9 | 1.0 | 0.8 | 0.6 |
| FUEL OIL | BBL | 1.6 | 1.7 | 1.7 | 2.7 |
| TOTAL OIL YIELD | BBL | 2.5 | 2.7 | 2.5 | 3.3 |
| HYDROGEN CONSUMPTION | WT % | 3.3 | 4.5 | 4.5 | 3.9 |
| CUFT/BBL OIL | | 5000 | 6300 | 6800 | 4600 |

[1]Use to produce hydrogen in balance with the hydrogen consumed. Figure in parenthesis total prior to hydrogen manufactures.

In analyzing the results of Table II, it should be noted that standard SRC-I was used as the feed to the second stage (i.e. solvent deashing) in the two stage coal liquefaction of the instant invention. Because the feed to the second stage was standard SRC-I, the full benefits of low severity hydrogen extraction (i.e. mild extraction) for the first stage of the present invention in terms of throughput and hydrogen consumption were not realized and the results shown in Table I are, therefore, conservative. However, even the conservative results shown in Table I show a total liquid yield (naphtha plus fuel oil) of 3.3 barrels compared to 2.5–2.7 from the other three one stage processes. It should also be noted that this higher liquid yield was produced with the lowest hydrogen consumption per unit of liquid yield (cf. 4600 cuft/bbl vs. 5000–6800 cuft/bbl).

In addition, an analysis of the liquids produced by the two stage process and apparatus of the present invention and the advanced one stage processes and apparatus mentioned above was made. The results are set forth in Table III below:

TABLE III

ANALYSIS OF LIQUIDS FROM VARIOUS LIQUEFACTION PROCESSES

| | HYDROGEN | NITROGEN | OXYGEN | SULFUR |
|---|---|---|---|---|
| SRC-I SOLID | 5.66 wt % | 2.09 wt % | 4.39 wt % | 0.80 wt % |
| SRC-II* | 8.60 wt % | 1.03 wt % | 2.91 wt % | 0.22 wt % |
| EDS* | 8.00 wt % | 0.70 wt % | 2.20 wt % | 0.50 wt % |
| H-COAL* | 9.36 wt % | 0.39 wt % | 0.55 wt % | 0.10 wt % |
| TWO STAGE | 8.90 wt % | 0.27 wt % | 0.29 wt % | 100 ppm (1 ppm = .0001 wt %) |

*Fuel Oil Fraction 400° F.+

Clearly the nitrogen, oxygen, and sulfur content of the liquid product produced by the two stage process and apparatus of the present invention is much lower than that produced in the advanced one stage processes and apparatus mentioned previously. Particular note should be made of the low sulfur content of 100 ppm achieved by the present invention.

While not being limited to the following theory, it is believed that the improved yield and quality of the product resulting from the practice of the present invention can be attributed to the fact that feeding a clean extract (produced by solvent deashing) to the catalytic second stage permits a more selective conversion at a lower temperature with as low or lower hydrogen consumption as compared to the three advanced one stage processes discussed previously. That is, the operation of the catalytic hydrocracker at lower temperatures reduces gas production, therefore, lowering hydrogen consumption and producing increased liquid yield.

Accordingly, it can be seen that the present invention is directed to a novel two stage coal liquefaction process and apparatus resulting in a higher yield of liquid product having enhanced quality.

The foregoing description of the preferred embodiments of the invention has been presented for purposes of illustration and description. It is not intended to be exhaustive or to limit the invention to the precise form disclosed, and obviously many modifications and variations are possible in light of the above disclosure. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A two stage process for converting solid, hydrogen-deficient, ash containing, hydrocarbonaceous material into liquid hydrocarbons which comprises a. solvent extracting a solid, hydrogen deficient, ash containing hydrocarbonaceous material in the presence of hydrogen to produce a liquid extract product, said extraction being performed at a temperature in the range of about 600°–850° F., a coal feed throughput rate of 150–250 lbs/hr/ft$^3$ and under hydrogen pressure in the range of about 1000 to 2000 psi;

b. solvent deashing to produce a clean extract; and c. hydrocracking said clean extract in a catalytic ebullating bed hydrocracker to produce liquid hydrocarbons, said hydrocracking being performed at a temperature in the range of about 750°–825° F. and under hydrogen pressure in the range of about 2000–3000 psi.

2. The process of claim 1 wherein the solvent extraction converts at least about 90 percent of said solid hydrogen-deficient, ash containing, hydrocarbonaceous material into a liquid extract product.

3. The process of claim 1 wherein the solid, hydrogen-deficient, ash containing, hydrocarbonaceous material is coal.

4. The process of claim 1 wherein the solid hydrogen-deficient, hydrocarbonaceous, ash containing, material is coal and the solvent extraction converts at least 90 percent of said coal into a liquid extract product.

5. A two stage process for converting solid, hydrogen-deficient, ash containing, hydrocarbonaceous, material into a liquid hydrocarbon product which comprises:

a. solvent extracting said solid, hydrogen-deficient, ash containing, hydrocarbonaceous material in the presence of hydrogen with a hydrogen donor solvent to convert substantially all of said solid, hydrogen-deficient, hydrocarbonaceous material into a liquid extract product, said extraction being performed at a temperature in the range of about 600°–850° F., a coal feed throughput rate of 150–250 lbs/hr/ft$^3$ and hydrogen pressure in the range of about 1000–2000 psi;

b. fractionating said liquid extract product to separate light liquids and gases from the heavy liquid extract;

c. solvent deashing said heavy liquid extract to obtain a clean extract;

d. removing said deashing solvent; and e. hydrocracking said clean extract in a catalytic ebullating bed hydrocracker to produce a liquid hydrocarbon product, said hydrocracking taking place at a temperature in the range of about 750°-825° F. and under hydrogen pressure in the range of about 2000-3000 psi.

6. The process of claim 5 wherein the solvent extraction converts at least 90 percent of said solid, hydrogen-deficient, ash containing, hydrocarbonaceous material into a liquid extract product.

7. The process of claim 5 wherein the liquid hydrocarbon product comprises light hydrocarbons ($C_4$–390° F.) and fuel oil (390°-850° F.).

8. The process of claim 5 wherein the hydrogen donor solvent is a process derived material.

9. The process of claim 6 wherein the catalyst is NiMo.

10. The process of claim 5 wherein the solid hydrogen-deficient, ash containing, hydrocarbonaceous material is coal.

11. The process of claim 10 wherein the solvent extraction converts at least 90 percent of said coal into a liquid extract product.

12. The process of claim 10 wherein the solvent extraction converts at least 90 percent of said coal into a liquid extract product.

* * * * *